US007930811B2

(12) United States Patent
Yoshida et al.

(10) Patent No.: US 7,930,811 B2
(45) Date of Patent: Apr. 26, 2011

(54) SLIDE DOOR TEMPORARY SETTING JIG FOR VEHICLE PAINTWORK OR INTERIOR WORK

(75) Inventors: Eiichi Yoshida, Tokyo (JP); Shigekatsu Yoshimura, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 563 days.

(21) Appl. No.: 12/091,238

(22) PCT Filed: Oct. 26, 2006

(86) PCT No.: PCT/JP2006/321920

§ 371 (c)(1), (2), (4) Date: May 12, 2008

(87) PCT Pub. No.: WO2007/049801

PCT Pub. Date: May 3, 2007

(65) Prior Publication Data

US 2009/0288596 A1 Nov. 26, 2009

(30) Foreign Application Priority Data

Oct. 28, 2005 (JP) ..... 2005-315015

(51) Int. Cl.
*B24B 27/14* (2006.01)

(52) U.S. Cl. ..... 29/281.5
(58) Field of Classification Search ..... 29/281.5
See application file for complete search history.

(56) References Cited

U.S. PATENT DOCUMENTS 6,248,172 B1 * 6/2001 Shirotani et al. ..... 118/500

FOREIGN PATENT DOCUMENTS

| | | | |
|---|---|---|---|
| DE | 4407996 | A1 | 10/1994 |
| FR | 2835233 | A1 | 8/2003 |
| GB | 1501466 | | 2/1978 |
| JP | 2001205150 | A | 7/2001 |

* cited by examiner

*Primary Examiner* — Joseph J Hail, III
*Assistant Examiner* — Shantese McDonald
(74) *Attorney, Agent, or Firm* — Standley Law Group LLP

(57) ABSTRACT

A vehicle slide door temporary setting jig includes a door position holding mechanism for holding a slide door in a desired angular position relative to a vehicle body. The door position holding mechanism has an end extension of one link lever of a linkage projecting beyond an associated link pin, an arcuate guide member pivoted to the free end of an attachment frame and configured to define a path of movement of a tip end portion of the end extension as the link lever turns about the link pin, and a resilient member acting between the free end of the attachment frame and the arcuate guide member and resiliently urging the arcuate guide member against the tip end portion of the end extension.

5 Claims, 6 Drawing Sheets

SLIDE DOOR TEMPORARY SETTING JIG FOR VEHICLE PAINTWORK OR INTERIOR WORK

TECHNICAL FIELD

The present invention relates to an improvement in a jig used for temporarily setting a slide door to a vehicle body for facilitating vehicle paintwork or interior work.

BACKGROUND ART

Motor vehicles having a rear door formed into a slidable construction are known and widely used heretofore. In the manufacture of such vehicles equipped with slide doors, a slide door and a vehicle body are initially produced separately and they are brought together in a painting process for securing color matching therebetween. In the painting process, various jigs are used so that the slide door can be temporarily set to a desired position relative to the vehicle body.

One example of such slide door temporary setting jigs is disclosed in Japanese Patent Laid-Open Publication (JP-A) No. 2001-205150. The disclosed jig, as shown here in FIGS. 6 and 7, includes a bar-like first attachment portion 102 having one end adapted to be removably connected to a vehicle body 101, a first bracket 103 pivotally connected at a central portion thereof to the other end of the first attachment portion 102, a first link arm 104 pivotally connected at one end thereof to one end of the first bracket 103, a second link arm 105 pivotally connected at one end thereof to the other end of the first bracket 103, a second bracket 106 to which other ends of the first and second link arms 104 and 105 are pivotally connected, and a second attachment portion 107 firmly connected to an end of the second bracket 106 and adapted to be removably connected to a slide door 108. The first bracket 103, the first link arm 104, the second link arm 105 and the second bracket 106 jointly form a quadrilateral linkage.

During the painting process, the slide door 108 is held in a closed position shown in FIG. 6, in which a front end of the slide door 108 is slightly displaced or offset in a lateral outward direction from a side surface of the vehicle body 101 so that a liquid paint used in the painting process can be easily removed from the interior side of the vehicle body through an opening defined between the front end of the slide door 108 and an adjacent edge of the vehicle body 101.

To enable a human operator to perform a vehicle interior work, the slide door 108 is moved in a rightward direction of FIG. 6 whereupon by virtue of displacement of the quadrilateral linkage, the slide door pivotally moves from the closed position of FIG. 6 to a fully opened position of FIG. 7, in which the slide door 108 opens at substantially right angles to the side surface of the vehicle body 101. In this position, an opening-motion limit pin 109 provided on the second link arm 105 in confronting relation to the first link arm 104 is brought into contact with the first link arm 104 so that further movement of the first link arm 104 in a rightward direction in FIG. 7 does not take place. Furthermore, a closing-motion limit pin 112 is inserted in a retainer hole 111 formed in the second link arm 105 so that the first link arm 104 is prevented from moving in a leftward direction in FIG. 7. Thus, the slide door 108 is locked in the fully opened position of FIG. 7.

The conventional jig 100 of the foregoing construction is, however, not fully satisfactory in that due to the necessity of removable insertion of the closing-motion limit pin 112 into the retainer hole 111, the jig 100 renders the slide door setting operation tedious and time-consuming. Furthermore, since the closing-motion limit pin 112 is produced as a separate part structurally independent from a body of the jig 100, there is a certain risk of missing the pin 112. Moreover, the jig 100 has no means of holding the slide door in any desired open position located between the closed position of FIG. 6 and the fully opened position of FIG. 7.

It is therefore an object of the present invention to provide a vehicle slide door temporary setting jig which is easy to handle, can perform a slide door temporary setting operation efficiently in a relatively short period of time, and is capable of holding a slide door in a given angular position relative to the vehicle body.

DISCLOSURE OF THE INVENTION

According to the present invention, there is provided a vehicle slide door temporary setting jig comprising: an attachment frame having a fixed end removably connectable to a center pillar of a vehicle body and a free end opposite the fixed end; a non-parallel linkage pivotally connected to the free end of the attachment frame for undergoing pivotal movement in a horizontal plane, the linkage including a pair of laterally spaced link levers pivotally connected at one end to the free end of the attachment frame by means of link pins; a slide door attachment seat pivotally connected to an end of the linkage remote from the free end of the attachment frame, the slide door attachment seat being removably connectable to a slide door; and a door position holding mechanism for holding the slide door in a desired angular position relative to the vehicle body, the door position holding mechanism having an end extension of one of the link levers projecting beyond an associated one of the link pins, an arcuate guide member pivotally connected at one end to the free end of the attachment frame and configured to define a path of movement of a tip end portion of the end extension as the one link lever turns about the associated link pin, and a resilient member acting between the free end of the attachment frame and the arcuate guide member and resiliently urging the arcuate guide member against the tip end portion of the end extension.

With this arrangement, due to a frictional force acting between the arcuate guide member and the distal end portion of the end extension under the effect of the resiliency or spring force of the resilient member, the slide door can be held at a given angular position relative to the vehicle body without using a separate locking means such as a motion-limit pin 112 as required in the conventional jig previously discussed with reference to FIGS. 6 and 7. The jig is easy to handle and able to perform a slide door temporary setting operation in a relatively short period of time.

The arcuate guide member may have at least one recess formed in an inner peripheral edge thereof for receiving therein the tip end portion of the end extension. In the case where two recesses are formed in the inner peripheral edge of the arcuate guide member at an interval in a circumferential direction, one recess defines a closed position of the slide door relative to the vehicle body when it receives the tip end portion of the end extension, while the other recess defines a fully opened position of the slide door relative to the vehicle body when it receives the tip end portion of the end extension. Preferably, the at least one recess comprises a semicircular recess, and the tip end portion of the end extension includes a round pin extending parallel to an axis of the associated link pin and receivable in the semicircular recess.

In one preferred form of the invention, the resilient member comprises a tension coil spring having one end connected to the other end of the arcuate guide member.

Preferably, the attachment frame includes a lower attachment plate removably connectable to a lower portion of an inner surface of the center pillar, a lower support member extending horizontally for supporting thereon the lower attachment plate, a lower fork provided on an end of the lower support member, an upper attachment plate removably connectable to an upper portion of the inner surface of the center pillar, an upper support member extending horizontally for supporting thereon the upper attachment plate, an upper fork provided on an end of the upper support member, and a vertical connecting member connecting the lower and upper support members. The slide door attachment seat comprises an upper attachment plate removably connectable to an upper portion of an inner surface of the slide door, a lower attachment plate removably connectable to a lower portion of the inner surface of the slide door, and a vertical connecting member interconnecting the upper and lower attachment plates. The non-parallel linkage is provided in two sets, one being associated with the upper fork and the other with the lower fork, the respective other link levers of the two non-parallel linkage sets being connected together by a vertical connecting member so that the two linkage sets move in synchronism with each other.

BEST MODE FOR CARRYING OUT THE INVENTION

One preferred embodiment of the present invention will be described below in greater detail with reference to the accompanying sheets of drawings.

Figure 1:
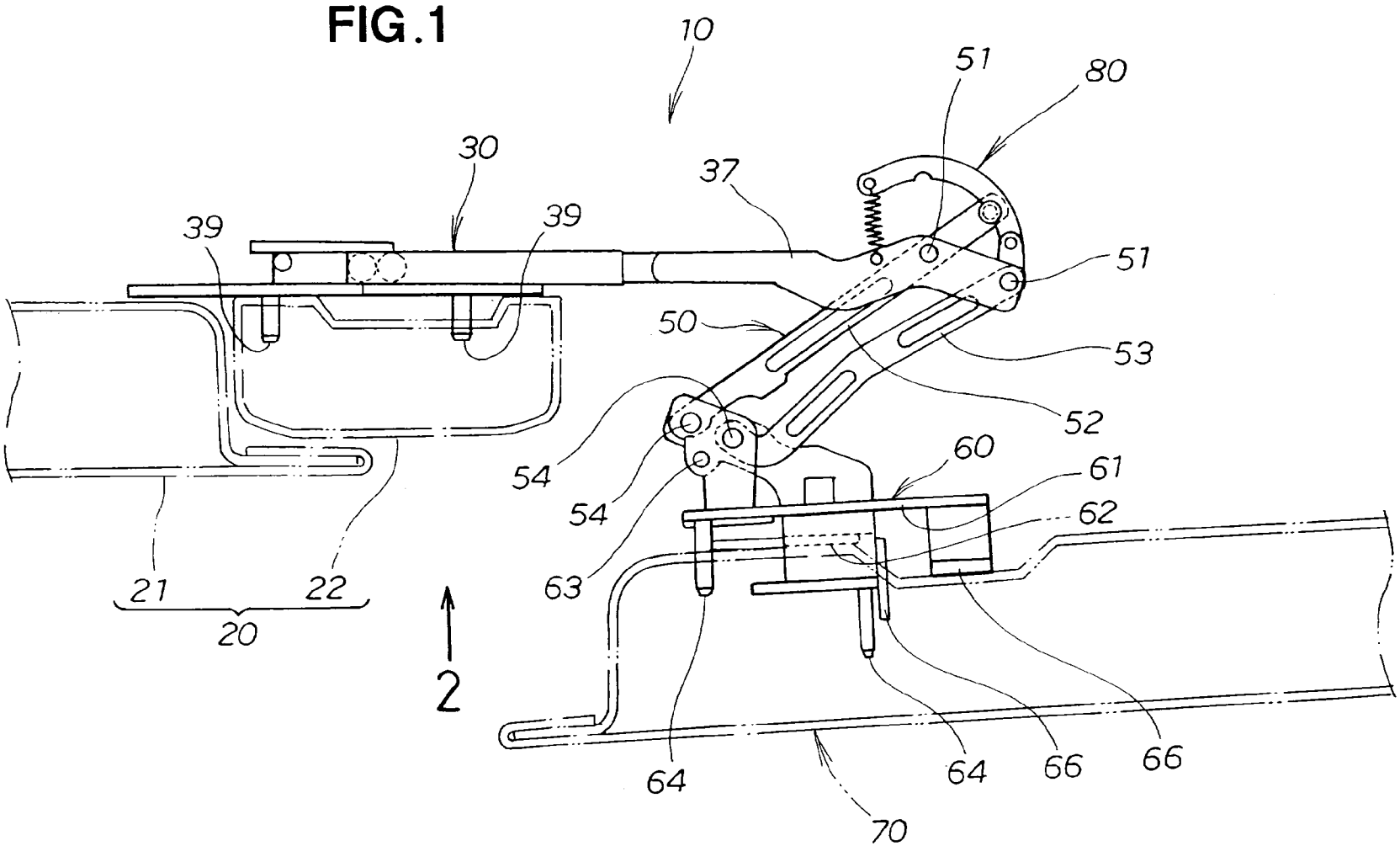
FIG. 1 is a plan view of a vehicle slide door temporary setting jig according to the present invention, the view showing a slide door in a closed position.

As shown in FIG. 1, a vehicle slide door temporary setting jig 10 embodying the invention generally comprises an attachment frame 30 having a fixed end removably connectable to an inside surface of a center pillar 22 of a vehicle body 20 and a free end opposite the fixed end, a non-parallel linkage 50 pivotally connected to the free end of the attachment frame 30 for undergoing pivotal movement in a horizontal plane, a slide door attachment seat 60 pivotally connected to an end of the non-parallel linkage 50 remote from the free end of the attachment frame 30 and removably connectable to a vehicle slide door 70, and a door position holding mechanism 80 mounted on the attachment frame 30 for holding the slide door 70 in a given angular position relative to the vehicle body 20.

The non-parallel linkage 50 has a first link lever 52 pivotally connected at one end thereof to the free end of the attachment frame 30 by means of a first link pin 51 and, at the other end thereof, to the slide door attachment seat 60 by means of a second link pin 54, and a second link lever 53 laterally spaced from the first link lever 52 and pivotally connected at one end thereof to the free end of the attachment frame 30 by means of a first link pin 51 and, at the other end thereof, to the slide door attachment seat 60 by means of a second link pin 54. The first and second link levers 52 and 53 lie in a horizontal plane and the first and second link pins 51 and 54 are disposed vertically so that the link levers 52, 53 are pivotally movable about the associated first link levers 51 in the horizontal plane.

Figure 2:
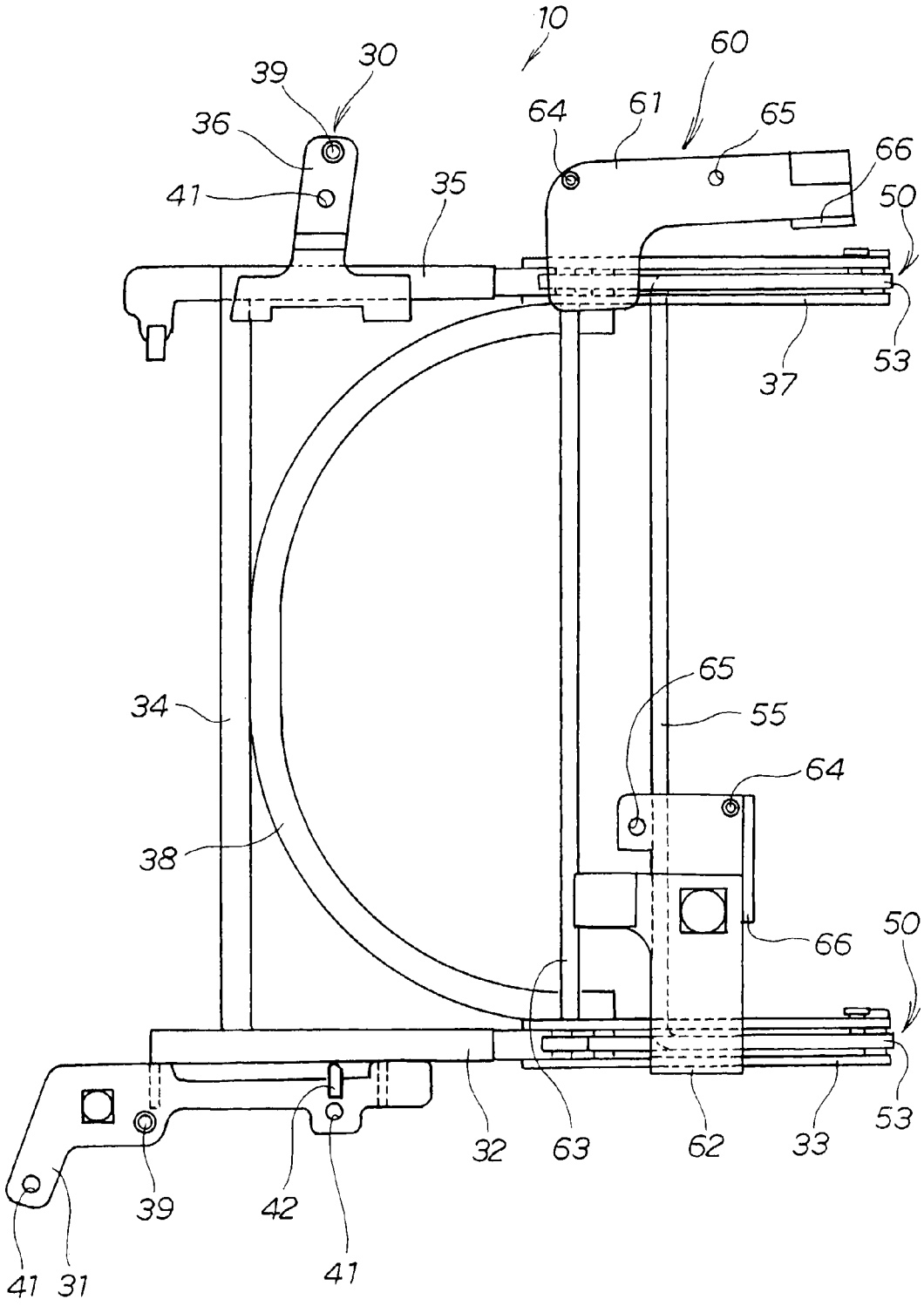
FIG. 2 is a front view in a direction of the arrow 2 of FIG. 1.

As shown in FIG. 2, the attachment frame 30 includes a lower attachment plate 31 disposed vertically and removably connectable to a lower portion of the inner surface of the center pillar 22 (FIG. 1), a rod-like lower support member 32 extending horizontally for supporting thereon the lower attachment plate 31, a lower fork 33 provided on one end (right end in FIG. 2) of the lower support member 32, a vertical connecting member 34 extending vertically upward from the other end (left end in FIG. 2) of the lower support member 32, a rod-like upper support member 35 extending horizontally and connected at one end portion thereof (left end portion in FIG. 2) to an upper end of the vertical connecting member 34, an upper attachment plate 34 supported by the upper support member 35 in a vertical position and removably connectable to an upper portion of the inner surface of the center pillar 22 (FIG. 1), an upper fork 37 provided on the other end (right end in FIG. 2) of the upper support member 35, and a C-shaped reinforcement member 38 connected at opposite ends thereof to the upper and lower forks 37 and 33 and, at a central portion thereof, to the vertical connecting member 34 so as to reinforce the attachment frame 30.

To ensure removable attachment of the attachment frame 30 to the center pillar 22 (FIG. 1) of the vehicle body 20, a plurality of fastener members 39, 41 and 42 are provided on the lower and upper attachment plates 31 and 36. In the illustrated embodiment, the fastener members comprise set pins 39 receivable in mating positioning holes of the center pillar 22, threaded holes 41 for threaded engagement with bolts to secure the attachment plates 31, 36 to the center pillar 22, and a hook 42 for hooking engagement with a mating part of the center pillar 22.

The non-parallel linkage 50 described above is provided in two sets: one being associated with the lower fork 33 and the other with the upper fork 37. More specifically, in the linkage 50 associated with the lower fork 33, the first and second link levers 52 and 53 are connected by the first link pins 51 to the lower fork 33 with one end portion of the levers received between respective upper and lower prongs (not designated) of the lower fork 33. Similarly, in the linkage 50 associated with the upper fork 37, the first and second link levers 52 and 53 are connected by the first link pins 51 to the upper fork 37 with one end portion of the levers received between respective upper and lower prongs (not designated) of the upper fork 37. The second link lever 53 of the upper linkage 50 and the second link lever 53 of the lower linkage 50 are connected together by a vertical connecting member 55 so that the upper and lower linkages 50 are movable in synchronism with each other.

The slide door attachment seat 60 is comprised of an upper attachment plate 61 disposed vertically and removably connectable to an upper portion of an inner surface of the slide door 70 (FIG. 1), a lower attachment plate 62 disposed vertically and removably connectable to a lower portion of the inner surface of the slide door 70, and a rod-like vertically connecting member 63 interconnecting the upper and lower attachment plates 61 and 62.

To ensure removable attachment of the slide door attachment seat 60 to the slide door 70, a plurality of fastener members 64, 65 and 66 are provided on the upper and lower attachment plates 61 and 62. In the illustrated embodiment, the fastener members comprise set pins 64 receivable in mating positioning holes of the slide door 70, threaded holes 65 for threaded engagement with bolts to secure the attachment plates 61, 62 to the slide door 70, and support plates 66 for abutment with the inner surface of the slide door 70.

In the attachment frame 30 of the foregoing construction, the upper and lower attachment plates 36 and 37 form the fixed end of the attachment frame 30 where the attachment frame 30 is removably connectable to the center pillar 22 (FIG. 1) of the vehicle body 20. Similarly, free end portions of the upper and lower forks 37, 33 form the free end of the attachment frame 30 where one end of each linkage 50 is pivotally connected. The number of the upper attachment plates 36, 31 should by no means be limited to two as in the illustrated embodiment, but only one attachment plate may be used in which instance a single linkage 50 and a single attachment plate is used in combination with the single upper attachment plate.

Figure 3:
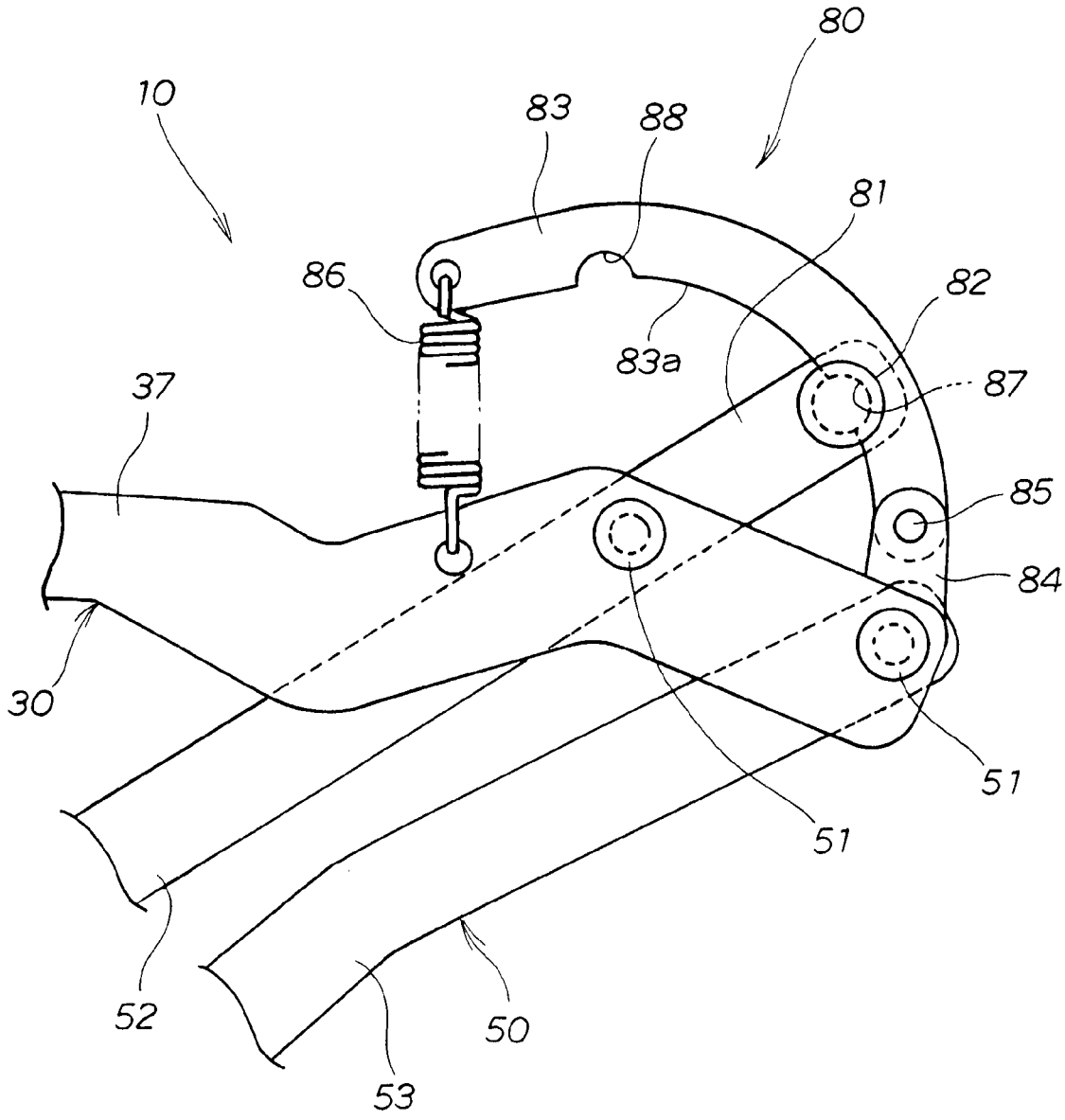
FIG. 3 is an enlarged plan view of a part of the jig shown in FIG. 1.

As shown in FIG. 3, the door position holding mechanism 80 comprises an end extension 81 of the first link lever 52 projecting beyond the first link pin 51, an arcuate guide member 83 pivotally connected at one end thereof to a distal end portion of the upper fork 37 by means of a pin 85 and so configured as to define a path of movement of a tip end portion of the end extension 81 as the first link lever 52 turns about the first link pin 51, and a resilient member 86 acting between the upper fork 37 and the arcuate guide member 83 and resiliently urging the arcuate guide member 83 against the distal end portion of the end extension 81.

Figure 4A:
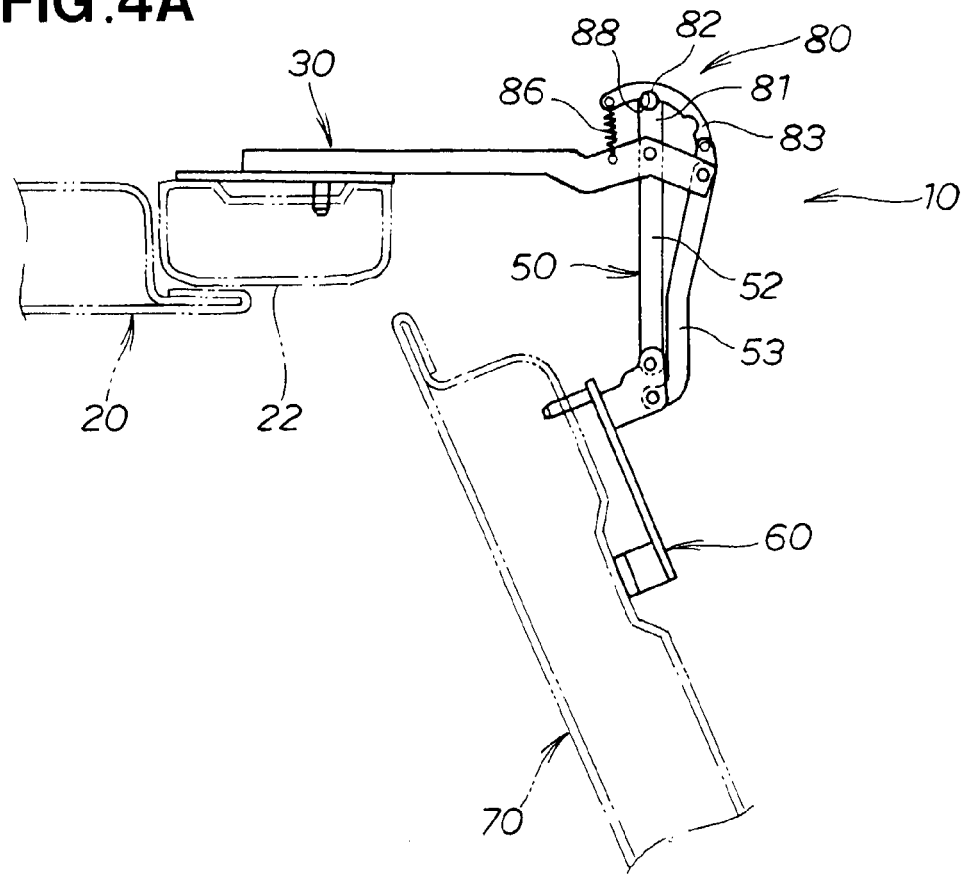
FIG. 4A is a view similar to FIG. 1, but showing the slide door as it is in a fully-opened position.

In the illustrated embodiment, the distal end portion of the upper fork 37 includes a laterally projecting support lug 84 to which the one end of the arcuate guide member 83 is connected by the pin 85. The distal end portion of the arcuate guide member 83 includes a round pin 82 extending parallel to an axis of the first link pin 51 of the first link lever 52 for sliding engagement with an inner peripheral edge 83*a* of the arcuate guide member 83. The arcuate guide member 83 has two semicircular recesses 87 and 88 formed in the inner peripheral edge 83*a* for receiving therein the round pin 82 on the distal end portion of the end extension 81. The semicircular recesses 87 and 88 are angularly spaced a predetermined distance about the first link pin 51 such that when the slide door 70 (FIG. 1) is in a closed position relative to the vehicle body 20, the pin 82 on the end extension 81 is received in the first semicircular recess 87, as shown in FIGS. 1 and 3, and when the slide door 70 is in a fully opened position relative to the vehicle body 20, the pin 82 on the end extension 81 is received in the second semicircular recess 87, as shown in FIG. 4A.

The arcuate guide member 83 may further have one or more semicircular recesses formed in the inner peripheral edge 83*a* thereof at a position located between the first semicircular recess 87 and the second semicircular recess 88. Alternatively, the first and second semicircular recesses 87, 88 may be omitted where appropriate. The resilient member 85 comprises a tension coil spring connected at one end thereof to a distal end (free end) of the arcuate guide member 83 and, at the other end thereof, to a relevant part of the upper fork 37. The tension coil spring 85 may be replaced by a rubber band or strip stretched between the distal end of the arcuate guide member 37 and the upper fork 37.

The door position holding mechanism 80 just described above is provided in conjunction with the upper linkage 50. Though not shown, a similar door position holding mechanism is also provided in conjunction with the lower linkage 50 (FIG. 2). However, the latter-mentioned door position holding mechanism can be omitted because the upper and lower linkages 50 are arranged to move in synchronism with each other by virtue of the respective second link levers 53, 53 connected together by the vertical connecting member 55 (FIG. 2).

The vehicle slide door temporary setting jig 10 of the foregoing construction operates as follows. For purposes of illustration, operation begins with parts shown in FIG. 4A where the attachment frame 30 of the jig 10 is connected at one end to a center pillar 22 of the vehicle body 20 and the pin 82 on the end extension 81 of the first link lever 52 is received in the second semicircular recess 88 formed in the inner peripheral edge 83*a* (FIG. 3) of the arcuate guide member 83. The slide door attachment seat 60 of the jig 10 is connected to a slide door 70 to be painted in combination with the vehicle body 20. Since the pin 82 on the end extension 81 is received in the second semicircular recess 88 of the arcuate guide member 83, the slide door 70 attached to the slide door attachment seat 60 is held in the fully opened position under the resiliency or spring force of the resilient member (tension coil spring) 86.

Then, the slide door 70 is forced or pressed to close a door opening of the vehicle body 20 in the same manner as a conventional hinged door. This causes the first and second link levers 52 and 53 to turn clockwise about the first link pins 51, 51, as shown in FIG. 4B, during which time the pin 82 on the end extension 81 of the first link lever 52 moves out from the second semicircular recess 88 against the force of the tension coil spring 86 and subsequently slides along the inner peripheral edge 83*a* (FIG. 3) of the arcuate guide member 83 in a rightward direction toward the first semicircular recess 87.

When a pressure on the slide door 70 is removed, the slide door 70 is held at that angular position (shown in FIG. 4B, for example) due to a frictional force acting between the pin 82 on the end extension 81 and the inner peripheral edge 83*a* (FIG. 3) of the arcuate guide member 83 under the effect of the spring force or resiliency of the tension coil spring (resilient member) 88 acting in a direction to urge the arcuate guide member 83 against the pin 82.

Figure 4B:
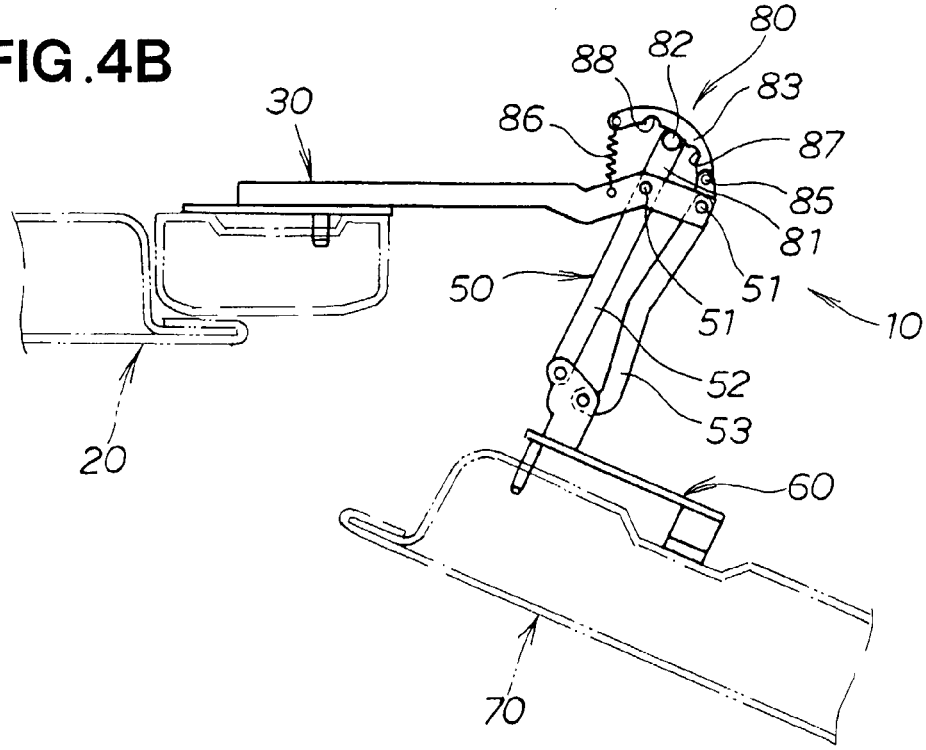
FIG. 4B is a view similar to FIG. 1, but showing the slide door as it is in a partly open position located between the closed position of FIG. 1 and the fully-open position of FIG. 4A.

When the slide door 70 is forced again toward the vehicle body 20, the first and second link levers 52 and 53 turn clockwise in FIG. 4B about the first link pins 51, 51, causing the pin 82 to move in fitting engagement with the first semicircular recess 87, as shown in FIG. 3. In this instance, the slide door 70 is in its closed position shown in FIG. 1. Then, a vehicle paintwork is started.

Figure 6:
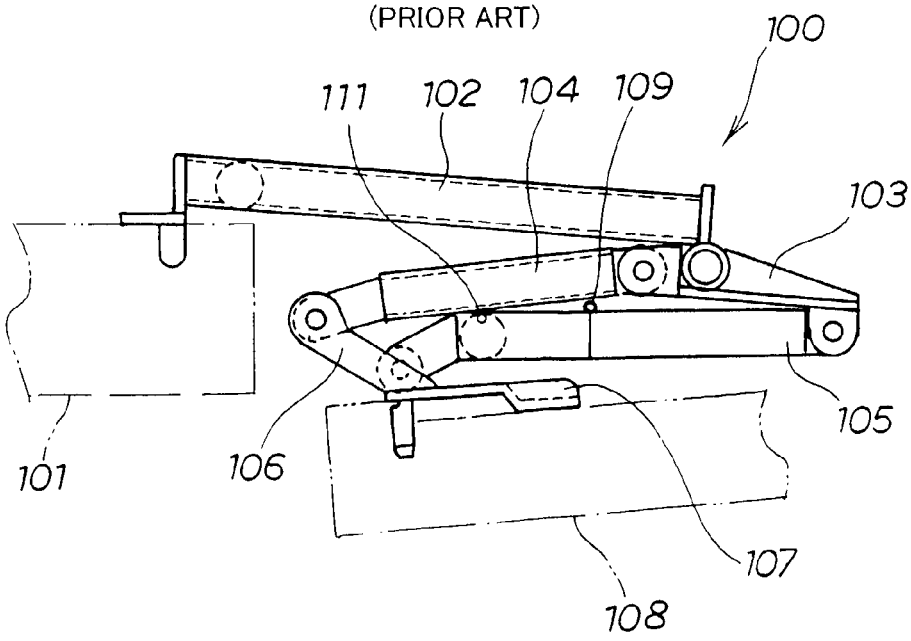
FIG.6 (PRIOR ART)
FIG. 6 is a plan view of a conventional vehicle slide door temporary setting jig, the view showing a slide door in a closed position.
Figure 7:
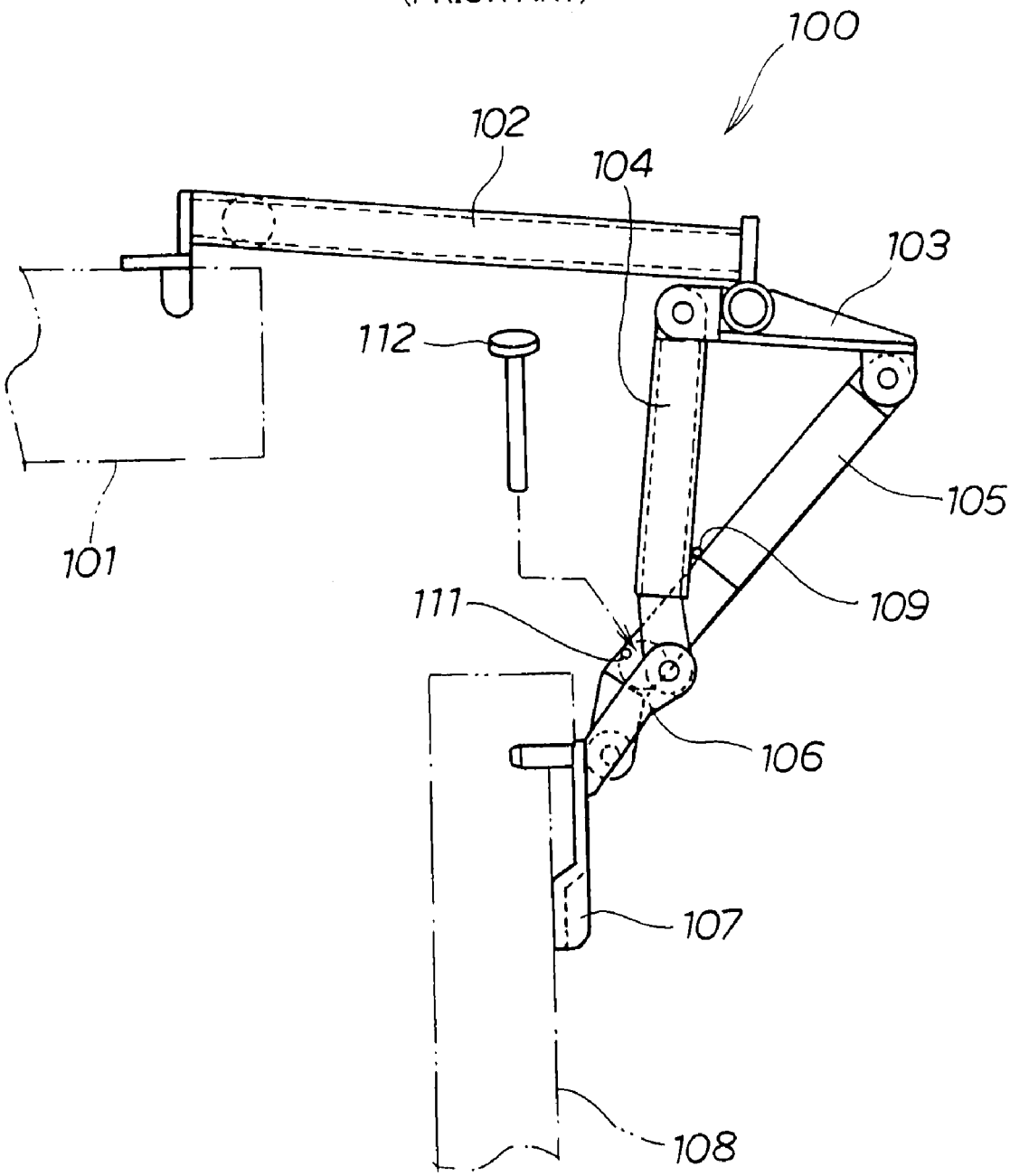
FIG.7 (PRIOR ART)
FIG. 7 is a view similar to FIG. 6, but showing the slide door in a fully opened position.

It can be readily appreciated that by virtue of the door position holding mechanism 80, the jig 10 is able to keep the slide door 70 at a given angular position relative to the vehicle body 20 between the closed position of FIG. 1 and the fully opened position of FIG. 4A without using a separate locking means such as a motion-limit pin 112 as required in the conventional jig previously discussed with reference to FIGS. 6 and 7. The jig 10 is easy to handle and able to perform a slide door temporary setting operation in a relatively short period of time.

Figure 5A:
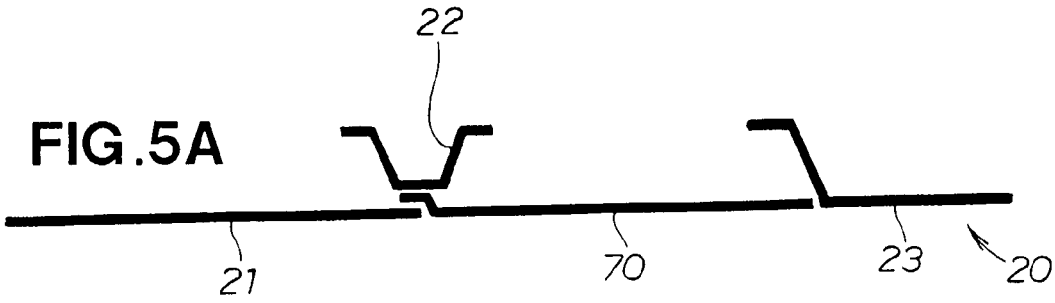
FIGS. 5A, 5B and 5C are diagrammatical views explanatory of an advantage attainable by the jig of the present invention used in conjunction with the vehicle paint work.
Figure 5B:
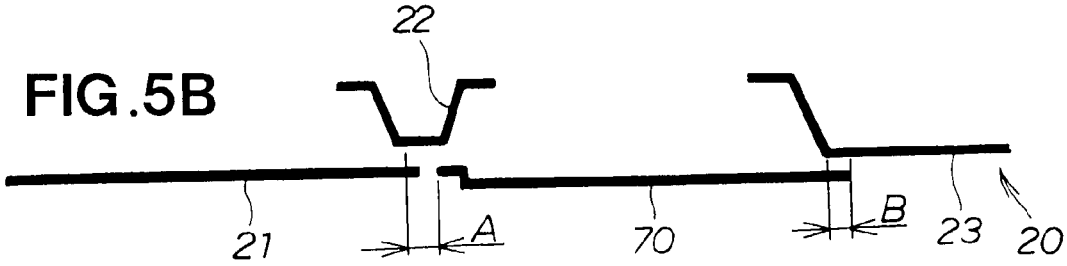
Figure 5C:
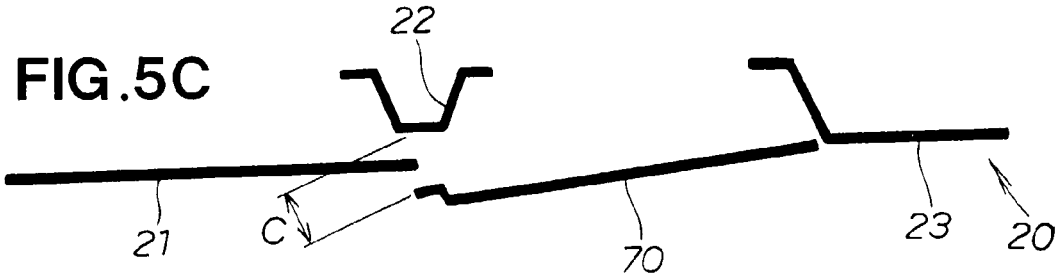

FIGS. 5A to 5C are diagrammatical views explanatory of an advantage attainable by the jig 10 used in conjunction with a vehicle paintwork.

In a vehicle having a slide door 70, when the slide door 70 is in a fully closed position shown in FIG. 55A, a front edge of the slide door 70 is disposed between an adjacent rear edge of a front portion 21 of the vehicle body and a center pillar 22. If the vehicle paintwork is performed with the slide door 70 shown in the fully closed position of FIG. 5A, the front edge portion will remain unpainted.

To avoid this problem, the slide door 70 is opened by a distance A as shown in FIG. 5B so that the front edge of the slide door 70 is located slightly rearward from the adjacent rear edge of the front portion 21. Thus, the vehicle paintwork is performed. In this instance, however, since a rear edge of the slide door 70 overlaps a front end portion of a rear fender 23 by a distance B, the front end portion of the rear fender 23 remains unpainted. To deal with this problem, the slide door 70 is returned to the fully closed position of FIG. 5A, and the unpainted front end portion of the rear fender 23 is painted. However, since a portion surrounding the unpainted front end portion of the rear fender 23 including the rear edge of the slide door 70 is painted twice, the painted vehicle body would involve color irregularity. Furthermore, the vehicle paintwork requires a relatively long time and higher cost.

According to the invention, by virtue of the slide door temporary setting jig 10 (FIG. 1), the slide door 70 is held in the closed position of FIG. 5C where the slide door 70 is slightly turned about the rear edge thereof in an outward direction to the extent that the front edge of the slide door 70 is outwardly displaced from the adjacent rear edge of the vehicle front portion 21 with a space C defined between itself and the front pillar 22. The slide door 70 does not have any portions overlapped with the front portion 21 and the rear fender 23. Thus, the vehicle body including the slide door can be painted in a single run and hence is evenly colored. Furthermore, the vehicle paintwork requires a relatively short period of time and can be achieved less costly.

INDUSTRIAL APPLICABILITY

With the arrangements so far described, the present invention can be used advantageously as a vehicle slide door temporary setting jig for setting a slide door in a given angular position relative to a vehicle body for facilitating the vehicle paintwork or interior work.

The invention claimed is:

1. A vehicle slide door temporary setting jig comprising:

an attachment frame having a fixed end removably connectable to a center pillar of a vehicle body and a free end opposite the fixed end;

a non-parallel linkage pivotally connected to the free end of the attachment frame for undergoing pivotal movement in a horizontal plane, the linkage including a pair of laterally spaced link levers pivotally connected at one end to the free end of the attachment frame by means of link pins;

a slide door attachment seat pivotally connected to an end of the linkage remote from the free end of the attachment frame, the slide door attachment seat being removably connectable to a slide door; and a door position holding mechanism for holding the slide door in a desired angular position relative to the vehicle body, the door position holding mechanism having an end extension of one of the link levers projecting beyond an associated one of the link pins, an arcuate guide member pivotally connected at one end to the free end of the attachment frame and configured to define a path of movement of a tip end portion of the end extension as the one link lever turns about the associated link pin, and a resilient member acting between the free end of the attachment frame and the arcuate guide member and resiliently urging the arcuate guide member against the tip end portion of the end extension.

2. The vehicle slide door temporary setting jig as recited in claim 1, wherein the arcuate guide member has at least one recess formed in an inner peripheral edge thereof for receiving therein the tip end portion of the end extension.

3. The vehicle slide door temporary setting jig as recited in claim 2, wherein the at least one recess comprises a semicircular recess, and the tip end portion of the end extension includes a round pin extending parallel to an axis of the associated link pin and receivable in the semicircular recess.

4. The vehicle slide door temporary setting jig as recited in claim 1, wherein the resilient member comprises a tension coil spring having one end connected to the other end of the arcuate guide member.

5. The vehicle slide door temporary setting jig as recited in claim 1, wherein the attachment frame includes a lower attachment plate removably connectable to a lower portion of an inner surface of the center pillar, a lower support member extending horizontally for supporting thereon the lower attachment plate, a lower fork provided on an end of the lower support member, an upper attachment plate removably connectable to an upper portion of the inner surface of the center pillar, an upper support member extending horizontally for supporting thereon the upper attachment plate, an upper fork provided on an end of the upper support member, and a vertical connecting member connecting the lower and upper support members, wherein the slide door attachment seat comprises an upper attachment plate removably connectable to an upper portion of an inner surface of the slide door, a lower attachment plate removably connectable to a lower portion of the inner surface of the slide door, and a vertical connecting member interconnecting the upper and lower attachment plates, and wherein the non-parallel linkage is provided in two sets, one being associated with the upper fork and the other with the lower fork, the respective other link levers of the two non-parallel linkage sets being connected together by a vertical connecting member.

* * * * *

UNITED STATES PATENT AND TRADEMARK OFFICE

CERTIFICATE OF CORRECTION

PATENT NO. : 7,930,811 B2
APPLICATION NO. : 12/091238
DATED : April 26, 2011
INVENTOR(S) : Yoshida et al.

It is certified that error appears in the above-identified patent and that said Letters Patent is hereby corrected as shown below:

In column 7, line 2, please delete "FIG. 55A" and insert -- FIG. 5A --.

Signed and Sealed this
Thirty-first Day of May, 2011

David J. Kappos

David J. Kappos
*Director of the United States Patent and Trademark Office*